US006968578B2

(12) United States Patent
Bernsley

(10) Patent No.: US 6,968,578 B2
(45) Date of Patent: Nov. 29, 2005

(54) CHILD'S DISPOSABLE TOILET SEAT ADAPTOR WITH SIDE HANDLES AND FOLD-UNDER FLAP

(76) Inventor: Mark Bernsley, 22820 Calabash St., Woodland Hills, CA (US) 91364

( * ) Notice: Subject to any disclaimer, the term of this patent is extended or adjusted under 35 U.S.C. 154(b) by 0 days.

(21) Appl. No.: 10/608,720

(22) Filed: Jun. 26, 2003

(65) Prior Publication Data

US 2004/0199986 A1 Oct. 14, 2004

Related U.S. Application Data

(60) Provisional application No. 60/412,860, filed on Sep. 24, 2002.

(51) Int. Cl.[7] ..... A47K 13/06
(52) U.S. Cl. ..... 4/239; 4/235; 4/245.3
(58) Field of Search ..... 4/235, 239, 245.1, 4/245.3, 245.4, 245.6–245.9

(56) References Cited

U.S. PATENT DOCUMENTS

| | | | | |
|---|---|---|---|---|
| 1,996,950 | A * | 4/1935 | Brooke, Jr. | 4/245.3 |
| 2,548,238 | A * | 4/1951 | Potts et al. | 4/239 |
| 2,716,244 | A | 8/1955 | Wendel | |
| 2,825,070 | A | 3/1958 | Alexander | |
| D346,206 | S * | 4/1994 | Crossley et al. | D23/296 |

* cited by examiner

*Primary Examiner*—Charles E. Phillips

(57) ABSTRACT

A barrier comprised of a single sheet of inexpensive, disposable and foldable material, sufficient in width to rest upon the full-size toilet seat, with a central cutout sized and positioned so as to provide a smaller toilet seating surface to accommodate the buttocks of a toddler, and which is capable of supporting a child's weight as a result of such material's natural firmness and folds along the distal edge, comprises a disposable toilet seat cover/adapter. Key innovative features include side handles and a fold-under flap to secure the toilet seat in place.

11 Claims, 4 Drawing Sheets

CHILD'S DISPOSABLE TOILET SEAT ADAPTOR WITH SIDE HANDLES AND FOLD-UNDER FLAP

This Appln Claims Benefit of 60/412,860, filed Sep. 24, 2002

BACKGROUND OF THE INVENTION

1. Field of the Invention

The present invention relates generally to disposable child toilet seat adapters which facilitate a toddler's use of public and other unfamiliar toilets and provide a clean seating surface.

For many, the prospect of using a public toilet is an unpleasant one. Thoughts of how many strangers have used the toilet before, and when and how well it was last cleaned, are enough to make some people do extraordinary things to avoid the experience. In addition, when a child needs to use the restroom, they generally can't wait. Exacerbating the foregoing general concern are the additional difficulties arising because public toilet seats are generally designed for adults, and children simply don't "fit" so well.

2. Description of Prior Art

Most toilets, including most public toilets are designed for use by adults. Small children who have learned to use toilets must generally be held on or over the seat. In addition to the size issue, the use of public and other unfamiliar toilets also involves the potential risk of infection, disease or contact with filth if the available toilet has not been cleaned adequately, or at all, since its last uses. This potential condition also suggests the need for some clean barrier between the user and the toilet. While products such as paper seat covers are often provided for such purpose, they are designed to fit the adult-sized toilet and provide little protection for a smaller child. In addition, the tendency of such temporary barriers to move and shift is undesirable and creates risks of contamination not present with a more stable barrier.

Several inventions have described disposable and non-disposable child or infant toilet seat adapters. These are identified and briefly described below:

1. U.S. Pat. No. 2,548,238 issued to Potts et. al. on Apr. 10, 1951 for "AUXILIARY TOILET SEAT".

2. U.S. Pat. No. 2,716,244 issued to Wendel on Aug. 30, 1955 for "TOILET SEAT ADAPTOR".

3. U.S. Pat. No. 2,825,070 issued to Alexander on Mar. 4, 1958 for "DISPOSABLE INFANT'S TOILET SEAT".

The devices of the prior art suffer from either not being disposable, from involving set-up procedures which are too cumbersome or complex, from having inadequate means for keeping the device in place on the toilet, and/or from failing to provide a position for the toddler's hands, which would otherwise be inclined to grasp the sides of the toilet, which are potentially contaminated with filth.

In addition to the above prior art, the following prior art patents are also relevant:

1. U.S. Pat. No. 1,582,527 issued to Marks on Apr. 27, 1926 for "SAFETY TOILET SEAT COVER". This device discloses the concept of side flaps which may be put under the seat to secure the disposable seat to the toilet. However, they involve an extensive amount of material under the toilet seat which will make it cumbersome and more difficult for a child to sit on the seat. In addition, the material is made out of flimsy paper which is not substantial enough to support the weight of a child and not substantial enough to firmly hold the disposable seat on the toilet.

2. U.S. Pat. No. 1,522,699 issued to Reid on Jan. 13, 1925 for "TOILET SEAT COVER". This device basically has surrounding rims which enable the toilet seat to be wedged around the rim but in fact do not securely hold the toilet seat cover on the toilet seat.

3. U.S. Pat. No. 6,473,911 B2 issued on Nov. 5, 2002 to Weiss for "DISPOSABLE, COMPACT, PORTABLE TODDLER-SIZE TOILET SEAT PROTECTOR". This device is also a toilet seat cover but has side flaps and front flaps which serve to wedge the front portion of the toilet seat between them. However, this is not a secure and stable way to assure that the toilet seat will remain on the toilet. In addition, the Weiss device has a large amount of folding that needs to be created before the disposable toilet seat cover is operational which makes it impractical for a parent to assemble while an impatient child is waiting to eliminate.

All of the above prior art patents lack the concept of having a handle by which the child can firmly grasp onto the toilet seat and remain on the toilet seat during the process of eliminating. In addition, none of these devices have a proper secure way of assuring that the toilet cover will be firmly held on the toilet seat while the child is moving around on the toilet seat during the process of elimination. There is a significant need for a new and improved disposable toilet seat cover with these improved features.

SUMMARY OF THE INVENTION

In accordance with the present invention, a barrier comprised of a single sheet of inexpensive, disposable and foldable material, sufficient in width to rest upon the full-size toilet seat, with a central cutout sized and positioned so as to provide a smaller toilet seating surface to accommodate the buttocks of a toddler, and which is capable of supporting a child's weight as a result of such material's natural firmness and folds along the distal edge, comprises a disposable toilet seat cover/adapter. The present invention is held in place by one or more flaps which are folded around and under the hinged adult seating surface so that such flap(s) rest(s) sandwiched between the underside of the adult seating surface and the top of the toilet rim. The weight of the child thus compresses the flap(s) and holds the seat adaptor in place.

In addition, the preferred embodiment includes handles for the child to grasp, thus limiting the temptation to touch surfaces of the toilet which might be contaminated with filth.

Objects and Advantages

The objects and advantages of the invention are:

(a) to provide an adapter-barrier means for a small child to use an adult-size toilet;

(b) for such means to be light and easily transported;

(c) for such means to be inexpensive;

(d) for such means to be capable of being assembled or prepared for use quickly and easily;

(e) for such means to remain in position while in use;

(f) for such means to provide a position for the child's hands so that there is little temptation to touch or grab exposed parts of the toilet.

(g) for such means to be easily disposed of after use.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
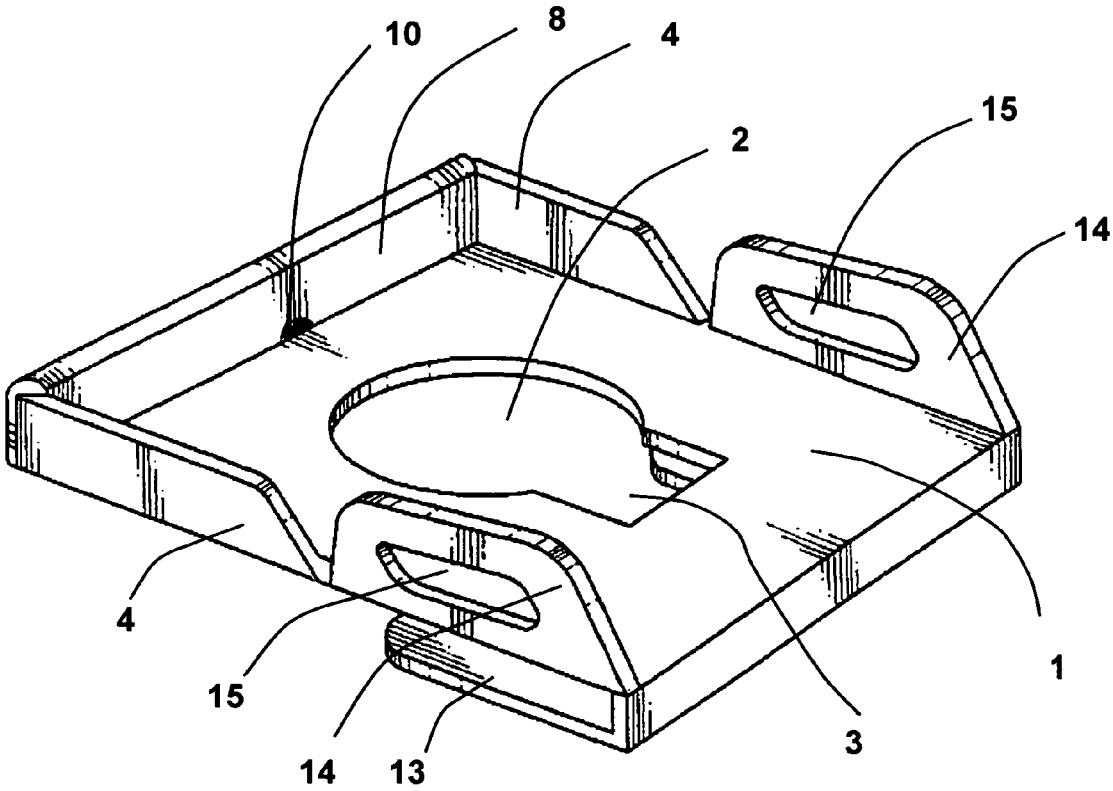
FIG. 1 is an oblique view of a device of the present invention, consisting of a child seating surface, 1, cutout hole, 2, side support flaps, 4, back support flap 8 and side Handle Flaps, 14, with Handle cutouts, 15.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 3:
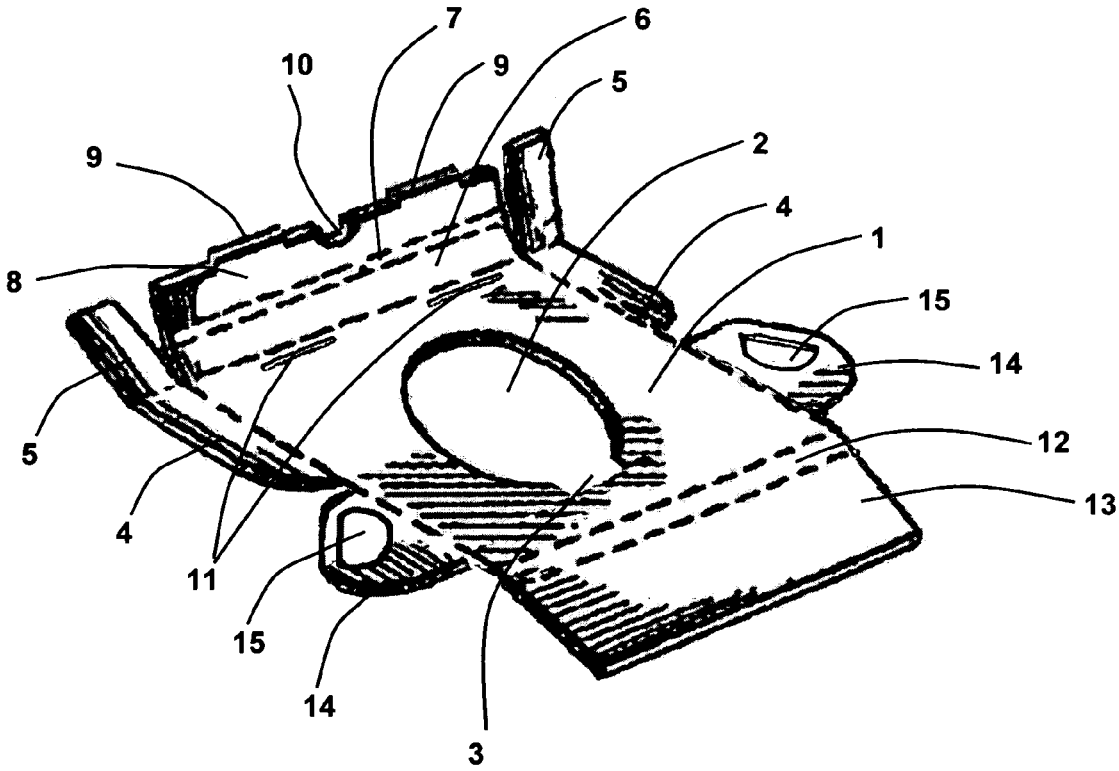
FIG. 3 shows the present invention unfolded, with the various sections exposed.
Figure 4:
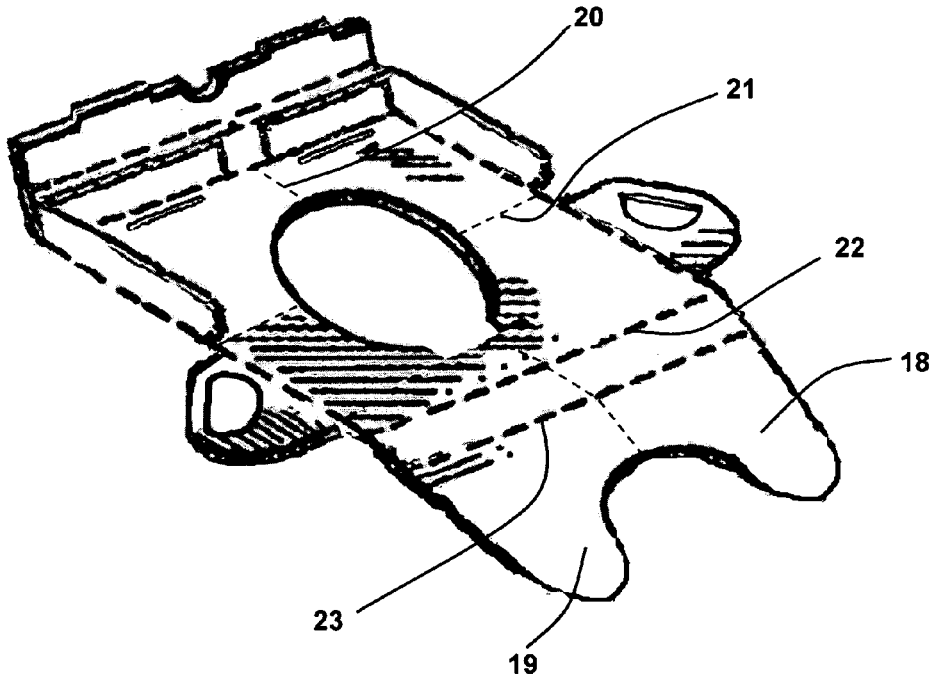
FIG. 4 shows an alternative embodiment of the present invention wherein the front flap has extensions which are able to extend under the spacers on a toilet seat.

Reference numerals in the drawings are as follows:

1. Adaptor seating surface
2. Cutout hole
3. Hole extension
4. Side portion of side support flap
5. Rear portion of side support flap
6. Outside portion of back support flap
7. Top, fold-over portion of back support flap
8. Inside portion of back support flap
9. Tabs
10. Finger cut-out for disassembly
11. Tab slots
12. Vertical portion of front fold-under flap
13. Front fold-under flap
14. Handle flap
15. Handle cutout
16. Toilet seat
17. Toilet bowl rim
18. A first extension on the front flap
19. A second extension on the front flap
20. Scored vertical centerline
21. Scored horizontal centerline
22. front fold-down score line
23. front fold-under score line The preferred embodiment of the present invention in its unfolded state is illustrated in FIG. 3, and comprises:

A single piece of corrugated cardboard or other inexpensive, firm material, cut into the shape shown and scored, creased or otherwise adapted to fold along the dotted lines. By the cuts and folds, the piece is comprised of a seating surface, 1, of sufficient width to rest on standard-sized toilet seats, with central cutout, 2, sized for the smaller buttocks of a toddler. Additional strength is provided by the assembly of 2-part Side Flaps, 4–5, and a Rear Support Flap, 6–10, which are folded to create a vertical ridge around the rear edge and the rear portion of the side edges of seating surface, 1.

Figure 2:
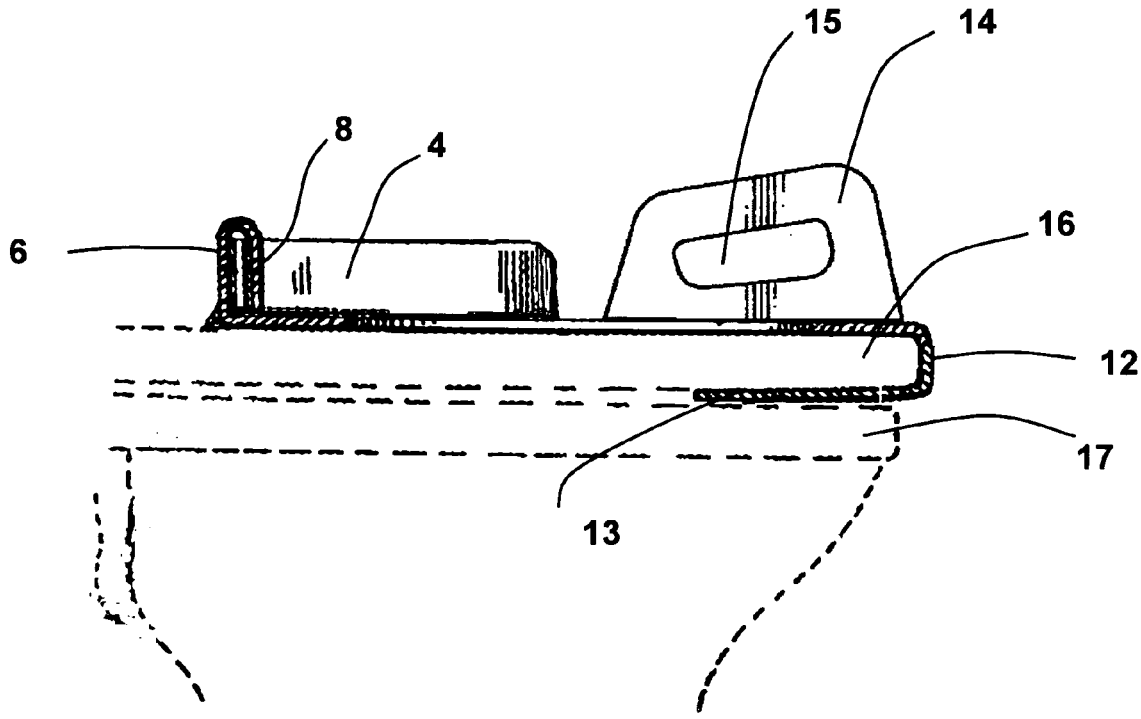
FIG. 2 shows a side view of the present invention situated on a toilet for use, showing the Front Fold-under Flap 13, situated between the toilet seat, 16 and toilet bowl rim, 17.

The present invention is assembled for use by folding the flaps as follows: with the Seating Surface, 1, situated horizontally, Side Flaps, 4, are folded up to a vertical position along the side edge of seating surface, 1, so as to be perpendicular to said seating surface, 1. Rear Portion of Side Support Flaps, 5, are folded such that they are vertical and perpendicular to the Side Flaps 4, situated along the rear edge of Seating Surface 1, adjacent to the Outside portion of back support flap, 6. The Outside portion of back support flap, 6, is folded up to a vertical position along the outside of Rear Portion of Side Support Flaps, 5, and the Inside portion of back support flap, 8, is folded down over the inside of Rear Support Flaps, 5, and the tabs, 9, are then inserted into the tab slots, 11. The seat is anchored in place by a Front, Fold-under Flap, 13, which is folded down along front fold-down score line 22, and then rearward under the adult toilet seat, 16, along front fold-under score line 23, such that the Vertical portion of Front fold-under flap, 12, covers the front edge of the toilet seat, 16 in FIG. 2, and the Front, Fold-under Flap, 13, is sandwiched between the toilet seat, 16, and toilet bowl rim, 17, as shown in FIG. 2. Handles are provided by a handle flap, 14, with handle cutouts, 15, which are folded to a vertical position for grasping.

FIG. 1 shows the present invention in its folded position, ready for use.

FIG. 2 shows the present invention situated on a toilet, ready for use.

After use, the unit is removed from the toilet; the rear portion of the device can be unfolded by inserting a finger in the Finger cut-out for disassembly, 10, and pulling the Inside portion of back support flap, 8, such that the Tabs, 9, are removed from the tab slots, 11, allowing the unit to be restored to an unfolded condition and discarded.

The present invention may be folded for storage and transportation in a variety of ways, and a vertical center score line (20) and horizontal score line (21) are provided in the preferred embodiment to facilitate such folding.

Alternative Embodiments

In the first alternative embodiment (not shown), the position of fold under flaps and handles are switched, such that two flaps are folded under the adult seat from the side, in the approximate position of the handles in the preferred embodiment, and a single handle is situate in a position to fold up from the center of the front section.

The barrier may be composed of extruded or corrugated plastic or other inexpensive but firm material.

The foldover flap assembly along the rear of the seat can be eliminated if the strength of the material used for the blank can bear sufficient weight to support a toddler without such folds.

The front of the Cutout Hole can contain a flap that folds up to provide a splash guard, similar to that provided in Alexander, 2,825,070.

The Front Fold-under flap can be divided into sections such that the center portion hangs straight down, providing a barrier between the child's legs and the front of the toilet, and the remaining, side portions fold under in the manner otherwise described herein.

The entire unit may contain additional folds to reduce it's storage size and facilitate its packaging and transportation.

Additional Alternative Embodiments

In addition to the above alternative embodiments, a preferred improvement in the present invention is to create extensions as illustrated by Numbers 18 and 19 on the front flap of the child toilet seat adapter. The front flap 13 is located along the front edge of the toilet seat adapter and is also located adjacent the front end of the toilet when the barrier is positioned on the toilet seat. The front flap 13 has a pair of oppositely disposed extensions 18 and 19 adjacent opposite sides of the front flap. The front flap folds so that it extends over the front rim of the toilet seat and extends under the front surface of the toilet seat such that a respective extension extends under a respective spacer on opposite locations of the underside of the toilet seat so that the front flap is sandwiched between the underside of the toilet seat and the top of the toilet rim and each respective extension is sandwiched between a spacer and the toilet rim.

Defined in detail, the present invention is a child toilet seat adapter to be used with a toilet having a toilet rim and an adult full sized toilet seat rotatable resting adjacent the toilet rim, the adult full sized toilet seat having a front surface including an underside having spacers on opposite sides of the underside which position the front of the toilet seat away from the toilet rim when the toilet seat is in its horizontal position, the child toilet seat adapter comprising: (a) a barrier having a front edge and two oppositely disposed side edges, the barrier comprised of a single sheet of foldable material sufficient in width to rest upon the full sized toilet seat with a central cutout sized and positioned so as to provide a smaller seating surface to accommodate the buttocks of a child; (b) a front flap located at the front edge of the barrier and also located. Adjacent the front end of the toilet when the barrier is positioned on the toilet seat, the front flap having a pair of oppositely disposed extensions adjacent opposite sides of the front flap, the front flap folded so that it extends over the front rim of the toilet seat and extends under the front surface of the toilet seat such that a respective extension extends under a respective spacer on opposite locations of the underside of the toilet seat so that the front flap is sandwiched between the underside of the toilet seat and the top of the toilet rim and each respective extension is sandwiched between a spacer and the toilet rim; (c) a first handle extending upwardly along one lengthwise edge of the barrier, the first handle having a cutout opening; and (d) a second handle extending upwardly along a second lengthwise edge of the barrier and parallel to said first handle, the second handle having a cutout opening; (e) whereby, when a child is seated on the barrier, the weight of the child compresses the front flap and its extensions between the toilet seat and the toilet seat spacer and the toilet rim to thereby cause the adapter to be held in place and the child grasps each handle through its cutout so that the child remains securely on the adapter.

Defined broadly, the present invention is a child toilet seat adapter to be used with a toilet having a toilet rim and an adult full sized toilet seat rotatable resting on the toilet rim, the adult full sized toilet seat having a front surface including an underside which rests against the toilet rim, the child toilet seat adapter comprising: (a) a barrier having a front edge and two oppositely disposed side edges, the barrier comprised of a single sheet of foldable material sufficient in width to rest upon the full sized toilet seat with a central cutout sized and positioned so as to provide a smaller seating surface to accommodate the buttocks of a child; (b) a front flap located at the front edge of the barrier and also located adjacent the front end of the toilet when the barrier is positioned on the toilet seat, the front flap folded so that it extends over the front rim of the toilet seat and extends under the front surface of the toilet seat so that it is sandwiched between the underside of the toilet seat and the top of the toilet rim; (c) a first handle extending upwardly along one lengthwise edge of the barrier, the first handle having a cutout opening; and (d) a second handle extending upwardly along a second lengthwise edge of the barrier and parallel to said first handle, the second handle having a cutout opening; (e) whereby, when a child is seated on the barrier, the weight of the child compresses the front flap between the toilet seat and the toilet rim to thereby cause the adapter to be held in place and the child grasps each handle through its cutout so that the child remains securely on the adapter.

Defined more broadly, the present invention is a child toilet seat adapter to be used with a toilet having a toilet rim and an adult full sized toilet seat rotatable resting adjacent the toilet rim, the adult full sized toilet seat having a front surface including an underside having spacers on opposite sides of the underside which position the front of the toilet seat away from the toilet rim when the toilet seat is in its horizontal position, the child toilet seat adapter comprising: (a) a barrier having a front edge and two oppositely disposed side edges, the barrier comprised of a single sheet of foldable material sufficient in width to rest upon the full sized toilet seat with a central cutout sized and positioned so as to provide a smaller seating surface to accommodate the buttocks of a child; (b) a front flap located at the front edge of the barrier and also located adjacent the front end of the toilet when the barrier is positioned on the toilet seat, the front flap having a pair of oppositely disposed extensions adjacent opposite sides of the front flap, the front flap folded so that it extends over the front rim of the toilet seat and extends under the front surface of the toilet seat such that a respective extension extends under a respective spacer on opposite locations of the underside of the toilet seat so that the front flap is sandwiched between the underside of the toilet seat and the top of the toilet rim and each respective extension is sandwiched between a spacer and the toilet rim; (c) whereby, when a child is seated on the barrier, the weight of the child compresses the front flap and its extensions between the toilet seat and the toilet seat spacer and the toilet rim to thereby cause the adapter to be held in place.

Defined even more broadly, the present invention is a child toilet seat adapter to be used with a toilet having a toilet rim and an adult full sized toilet seat rotatably resting adjacent the toilet rim, the adult full sized toilet seat having a front surface including an underside having spacers on opposite sides of the underside which position the front of the toilet seat away from the toilet rim when the toilet seat is in its horizontal position, the child toilet seat adapter comprising: (a) a barrier having a front edge and two oppositely disposed side edges, the barrier comprised of a single sheet of foldable material sufficient in width to rest upon the full sized toilet seat with a central cutout sized and positioned so as to provide a smaller seating surface to accommodate the buttocks of a child; (b) a first handle extending upwardly along one lengthwise edge of the barrier, the first handle having a cutout opening; and (c) a second handle extending upwardly along a second lengthwise edge of the barrier and parallel to said first handle, the second handle having a cutout opening; (d) whereby, when a child is seated on the barrier, the child grasps each handle through its cutout so that the child remains securely on the adapter.

Defined even more broadly, the present invention is a child toilet seat adapter to be used with a toilet having a toilet rim and an adult full sized toilet seat rotatably resting on the toilet rim, the adult full sized toilet seat having a front surface including an underside which rests against the toilet rim, the child toilet seat adapter comprising: (a) a barrier having a front edge and two oppositely disposed side edges, the barrier comprised of a single sheet of foldable material sufficient in width to rest upon the full sized toilet seat with a central cutout sized and positioned so as to provide a smaller seating surface to accommodate the buttocks of a child; and (b) a front flap located at the front edge of the barrier and also located adjacent the front end of the toilet when the barrier is positioned on the toilet seat, the front flap folded so that it extends over the front rim of the toilet seat and extends under the front surface of the toilet seat so that it is sandwiched between the underside of the toilet seat and the top of the toilet rim; (c) whereby, when a child is seated on the barrier, the weight of the child compresses the front flap and its extensions between the toilet seat and the toilet seat spacer and the toilet rim to thereby cause the adapter to be held in place.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A child toilet seat adapter for use on a standard toilet having a toilet bowl, a rim on the toilet bowl and a toilet seat which, when in use, rests upon the rim of the toilet bowl, said toilet seat adaptor comprising:

a. a seat portion having front, rear and side edges and being sufficient in width to rest upon the standard toilet seat with a central cutout sized and positioned so as to provide a smaller seating surface to accommodate the buttocks of a child;

b. the adapter being made from a single sheet of foldable material which is capable of supporting a child's weight as a result of such material's natural firmness with reinforcing folds along the adapter's rear edge;

c. a front told-under flap located at the front edge of the adaptor, which, facilitated by a first score line, being folded down over the front face of the toilet seat and then, facilitated by a second score line, being folded under the toilet seat between the toilet seat and a toilet bowl rim; and said front fold-under flap being of a shape and design such that, when folded down and under the toilet seat, it does not occlude the central cutout opening and nevertheless extends under the toilet seat in such manner and for a sufficient distance so as to be sandwiched between the underside of the toilet seat and the toilet bowl rim at one or more place or places where the underside of the toilet seat would otherwise rest upon and contact the toilet bowl rim; and so sandwiched, the front fold-under flap will be compressed between the toilet seat and toilet bowl rim by the weight of the child seated on the adaptor, by which means the adapter is maintained in place on the toilet seat.

2. A child toilet seat adapter in accordance with claim 1, further comprising:

a. first handle extending upwardly along one lengthwise side edge of the adaptor, the first handle having a cutout opening; and b. a second handle extending upwardly along a second lengthwise side edge of the adaptor and parallel to said first handle, the second handle having a cutout opening.

3. A child toilet seat adapter in accordance with claim 1, further comprising:

a. a pair of oppositely disposed side flaps each located adjacent a rear edge of the adapter and which is folded up to a vertical position along the side edges of the adapter so as to be perpendicular to the seating surface;

b. each side flap having a rear portion such that, when the side flap is folded up to a vertical position, the rear portion is folded so as to become both vertical and perpendicular to the side edges of the adapter; and c. a back flap folded up to a vertical position along the outside of the rear portion of the side support flaps and from thence the inside portion of the back support flap is folded forward and down over the inside of the rear portion of the side support flap, the back flap having tabs which are inserted into tab slots located on the rear surface of the adapter so that the back flap is vertically positioned to form a vertical rear barrier which provides additional support to the seating surface, and the side flaps are vertically positioned to maintain the rear barrier in a vertical position.

4. A child toilet seat adapter in accordance with claim 1, wherein said adapter is scored along its vertical centerline and its horizontal centerline so that it can be folded.

5. A child toilet seat adapter in accordance with claim 1, wherein said adapter is disposable.

6. A child toilet seat adapter in accordance with claim 1, wherein said adapter is made out of corrugated paperboard.

7. A child toilet seat adapter for use on a standard toilet having a toilet bowl, a rim on the toilet bowl and a toilet seat which, when in use, rests upon the rim of the toilet bowl, said toilet seat adaptor comprising:

a. a seat portion sufficient in width to rest upon the standard toilet seat with a central cutout sized and positioned so as to provide a smaller seating surface to accommodate the buttocks of a child;

b. the adapter being made from a single sheet of foldable material which is capable of supporting a child's weight as a result of such material's natural firmness with reinforcing folds along the adapter's rear edge;

c. a front fold-under flap located at the front edge of the adaptor, which, facilitated by score lines, is folded down over the front face of the toilet seat and then under the toilet seat between the toilet seat and a toilet bowl rim; and said front-fold under flap being of a shape and design such that, when folded down and under the toilet seat, it does not occlude the central cutout opening and nevertheless extends under the toilet seat in such manner and for a sufficient distance so as to be sandwiched between the underside of the toilet seat and the toilet bowl rim at one or more place or places where the underside of the toilet seat would otherwise rest upon and contact the toilet bowl rim; and so sandwiched, the front fold-under flap will be compressed between the toilet seat and toilet bowl rim by the weight of the child seated on the adaptor, by which means the adapter is maintained in place on the toilet seat;

d. a first handle, in the form of a fold-up flap, extending upwardly along one lengthwise side edge of the adaptor, the first handle having a cutout opening; and e. a second handle, in the form of a fold-up flap, extending upwardly along a second lengthwise side edge of the adaptor and parallel to said first handle, the second handle having a cutout opening.

8. A child toilet seat adapter in accordance with claim 7, further comprising:

a. a pair of oppositely disposed side flaps each located adjacent a rear edge of the adapter and which is folded up to a vertical position along the side edges of th& adapter so as to be perpendicular to the seating surface;

b. each side flap having a rear portion such that, when the side flap is folded up to a vertical position, the rear portion is folded so as to become both vertical and perpendicular to the side edges of the adapter; and c. a back flap folded up to a vertical position along the outside of the rear portion of the side support flaps and from thence the inside portion of the back support flap is folded forward and down over the inside of the rear portion of the side support flap, the back flap having tabs which are inserted into tab slots located on the rear surface of the adapter so that the back flap is vertically positioned to form a vertical rear barrier which provides additional support to the seating surface, and the side flaps are vertically positioned to maintain the rear barrier in a vertical position.

9. A child toilet seat adapter in accordance with claim 7, wherein said adapter is scored along its vertical centerline and its horizontal centerline so that it can be folded.

10. A child toilet seat adapter in accordance with claim 7, wherein said adapter is disposable.

11. A child toilet seat adapter in accordance with claim 7, wherein said adapter is made out of corrugated paperboard.

* * * * *